US009133620B1

(12) United States Patent
Huguet, Sr. et al.

(10) Patent No.: US 9,133,620 B1
(45) Date of Patent: Sep. 15, 2015

(54) PREFABRICATED PANEL SYSTEM

(71) Applicants: Rafael Huguet, Sr., Miami, FL (US); Rafael Huguet, Jr., Pinecrest, FL (US)

(72) Inventors: Rafael Huguet, Sr., Miami, FL (US); Rafael Huguet, Jr., Pinecrest, FL (US)

( * ) Notice: Subject to any disclaimer, the term of this patent is extended or adjusted under 35 U.S.C. 154(b) by 0 days.

(21) Appl. No.: 14/461,853

(22) Filed: Aug. 18, 2014

Related U.S. Application Data

(60) Provisional application No. 61/992,589, filed on May 13, 2014.

(51) Int. Cl.
*E04B 2/00* (2006.01)
*E04B 2/74* (2006.01)

(52) U.S. Cl.
CPC ..... *E04C 2/44* (2013.01); *E04B 2/7448* (2013.01)

(58) Field of Classification Search
CPC ..... E04B 2/7433; E04B 2/62; E04B 2/58; E04B 2/7401; E04B 2/7448; E04B 2/7453; E04B 2/7407; E04C 2/384; E04C 2002/3488
See application file for complete search history.

(56) References Cited

U.S. PATENT DOCUMENTS

| | | | | | |
|---|---|---|---|---|---|
| 1,578,344 | A | * | 3/1926 | Munroe | 52/592.1 |
| 2,142,305 | A | * | 1/1939 | Davis | 52/592.1 |
| 2,381,635 | A | * | 8/1945 | Baker | 52/241 |
| 3,358,411 | A | * | 12/1967 | Birum, Jr. | 52/241 |
| 3,888,059 | A | | 6/1975 | MacLennan et al. | |
| 4,037,379 | A | * | 7/1977 | Ozanne | 52/404.3 |
| 4,057,948 | A | * | 11/1977 | Wise | 52/584.1 |
| 4,201,020 | A | * | 5/1980 | Saunders | 52/580 |
| 4,443,988 | A | | 4/1984 | Coutu, Sr. | |
| 4,542,614 | A | | 9/1985 | Malachowski | |
| 4,689,930 | A | | 9/1987 | Menchetti | |
| 5,010,702 | A | * | 4/1991 | Daw et al. | 52/241 |
| 5,072,569 | A | * | 12/1991 | VanTassel | 52/745.1 |
| 5,483,778 | A | * | 1/1996 | Scrivener | 52/579 |
| 5,566,523 | A | * | 10/1996 | Ozanne | 52/655.1 |
| 5,638,651 | A | * | 6/1997 | Ford | 52/309.7 |
| 6,044,603 | A | * | 4/2000 | Bader | 52/309.7 |
| 6,112,851 | A | * | 9/2000 | Sugimoto et al. | 181/287 |
| 6,256,960 | B1 | | 7/2001 | Babcock et al. | |
| 6,843,035 | B1 | | 1/2005 | Glynn | |
| 7,568,318 | B1 | * | 8/2009 | Egan | 52/309.9 |
| 7,900,411 | B2 | | 3/2011 | Antonic | |
| 2004/0255539 | A1 | * | 12/2004 | Beavers et al. | 52/506.01 |
| 2007/0094992 | A1 | * | 5/2007 | Antonic | 52/656.1 |
| 2009/0282759 | A1 | * | 11/2009 | Porter | 52/220.1 |
| 2014/0059958 | A1 | * | 3/2014 | Ratto Anduaga | 52/309.3 |

FOREIGN PATENT DOCUMENTS

| | | | | |
|---|---|---|---|---|
| DE | 2802151 | A1 * | 7/1979 | E04B 2/74 |
| DE | 10304358 | A1 * | 8/2004 | E04C 2/02 |

* cited by examiner

*Primary Examiner* — Christine T Cajilig
(74) *Attorney, Agent, or Firm* — Malloy & Malloy, P.L.

(57) ABSTRACT

A prefabricated panel system includes a plurality of panel assemblies to be adjoined together to form partitions. A panel assembly comprises two panel members disposed in spaced relation via a plurality of connecting members disposed therebetween; at least one of the connecting members defining a male connector projecting from a male connecting end; at least one of the plurality of connecting members defining a female connector defining a recess in a female connecting end; the panel assembly connectable to at least one other panel assembly by disposing the male connector of one panel assembly within the recess of another panel assembly. The system also includes a base channel to be disposed along a floor to receive and house the prefabricated panel assemblies, as well as a cap channel to be disposed along a cap portion of the panel assemblies.

17 Claims, 8 Drawing Sheets

PREFABRICATED PANEL SYSTEM

CLAIM OF PRIORITY

This application claims the benefit of priority to the previously filed provisional application having Ser. No. 61/992,589 filed on May 13, 2014.

BACKGROUND OF THE INVENTION

1. Field of the Invention

The present invention is directed to a system of lower cost, superior strength, prefabricated panel assemblies, which may be quickly and easily assembled or erected into partitions.

2. Description of the Related Art

Prefabricated construction techniques often include the assembly of components of a structure in a factory or other manufacturing site and transportation of the assemblies to a construction site to be erected. As opposed to traditional, in-situ construction techniques, prefabrication provides a host of benefits such as shorter construction times, cost effectiveness, reduction of construction waste, etc. However, traditional prefabrication techniques are not without their disadvantages as well, such as the risk of leaks forming at joints as well as higher transportation costs of voluminous prefabricated assemblies versus the raw materials which may be more efficiently packed.

The present invention addresses these and other needs felt in the art by providing prefabricated panel assemblies that are efficiently packable and may be used to quickly and efficiently erect walls or partitions. Other benefits of the present invention will be illuminated in the sections below.

SUMMARY OF THE INVENTION

As stated above, the invention is directed toward a system of prefabricated panel assemblies which may be quickly and easily assembled into walls or partitions. The present invention provides a superior wall construction in several ways. First, the panel assemblies of the present invention are capable of being manufactured in a controlled environment to be inspected in a factory by building officials, dispensing with the need to perform inspections on-site, which can be a cumbersome process. Thus, the present invention is much quicker and less expensive than traditional wall construction. Furthermore, the factory construction is particularly amenable to template-based construction lending to more uniformity between partitions relative to traditional construction methods.

Second, one or more aspects of the invention are capable of being made from recycled materials. Third, the present invention is safer than traditional wall construction in that it can provide for varying degrees of fire resistance, as necessary. Furthermore, the present invention provides for relatively lightweight partitions which, for example, during an earthquake will tend to bend and/or twist, rather than shear and/or crack as is the case of walls constructed of brick, concrete blocks, and other heavy materials.

The base unit of the system is the panel assembly, one or more of which may be deployed as wall segments or partition segments as desired. The panel assemblies can include interconnecting structure which facilitates the quick and easy erection process. Other operative features of the invention include a base member which can be deployed along, for example, a floor, to receive the panel assemblies. Likewise a cap member can be deployed along, for example, a ceiling, to receive the panel assemblies as well.

The panel assembly may be constructed from two panel members disposed in spaced relation and connected via a plurality of connecting members. The panel members are substantially planar, being much larger in length and width than in thickness, and also substantially rigid so as to not substantially deform under their own weight. In one embodiment, the panel members may be composed of a commonly used building material such as drywall, generally made from sandwiching gypsum plaster between sheets of thick paper. In such an embodiment, the panel member is ideal for use as an interior partition. Further still, panel members composed of drywall can easily provide varying degrees of fire resistance simply by varying the thickness of drywall. For example, a ½" thick drywall sheet may provide resistance to fire for approximately 30 minutes, whereas a ⅝" thick drywall sheet may provide resistance to fire for approximately 1 hour.

The panel members themselves may or may not be utilized in a load bearing configuration and as such may be composed of essentially any suitable or desirable material depending upon the desired use and deployment of the system. For example, when deployed as only a temporary partition in an indoor environment, the panel members may be made of inexpensive and light weight materials such as foam, particle board, chip board, recycled materials, and the like.

Another operative feature of the present invention is the spaced relation of the panel members caused by mounting each panel member to a different side of a plurality of connecting members. In one embodiment, the spaced relation provides an air gap in between the correspondingly disposed panel members in which, for example, electrical or plumbing conduits may be disposed. In other embodiments the air gap may be filled with various materials in order to further enhance one or more characteristics of the panel assembly such as thermal insulation, acoustical insulation, fire resistance, and the like. Accordingly, the air gap may then be filled with foam, expanded polystyrene pellets, honeycomb paper, fiber glass insulation, and the like. Such filler material may be predisposed within a panel assembly by a manufacturer of the present invention, or it may also be desirable to allow users of the present invention to dispose their own desired filler material within the air gap. In yet further embodiments, structural elements, such as a plurality of connecting members, may be disposed at desired intervals along the air gap in order to increase the structural strength of the panel assembly. It will be appreciated that embodiments of the present invention which include filler material and embodiments of the present invention which provide for the passage of conduits between the panel members are not mutually exclusive.

A connecting member of the present invention is generally an elongate and rigid structure which includes facilities for the secure attachment of panel members thereto. In at least one embodiment, a connecting member comprises a beam which includes at least one web and a plurality of flanges, such as a structural channel or "c-beam". Such a c-beam can be made of aluminum or steel, such as those employed in drywall construction as studs. Each panel member of the panel assembly may be attached to a flange of a connecting member, while the web provides spacing for the air gap and serves to reinforce the beam under bending loads, such as those produced by pressure directed normally to a panel member, thereby enhancing its structural strength.

Aside from enhancing the structural strength and/or rigidity of the panel assembly, the connecting members may also be utilized to facilitate erection of a plurality of panel assemblies by providing a relatively easy connection means between adjacent panel assemblies. In one embodiment, a connecting member, can be disposed on one end of a panel assembly, a male connecting end, such that the web and at least a portion of each flange extends therefrom, forming a male connector. On the opposite end of the panel assembly, the female connecting end, there may be disposed a connecting member with its web recessed inwardly from the female connecting end, forming a female connector and at least partially defining a recess into which a male connector is disposable. By forming a plurality of male connectors and female connectors identically on each of a plurality of panel assemblies, an easy erection method may be performed whereby the male connector of one panel assembly may be disposed within the recess partially defined by the female connector of an adjoining panel assembly and so forth until a desired length of wall or partition is accomplished. Each panel may further be securely retained by inserting fasteners through the female connecting end of one panel assembly and through the male connector of a correspondingly disposed adjoining panel assembly.

In embodiments where the connecting members comprise structural channels, or "c-beams," the male connector and female connector may be correspondingly oriented and disposed such that upon insertion of the male connector within the recess partially defined by female connector, the respective web portions of each rest in substantially abutting disposition thereby forming a cross-section which is in a substantially I-beam configuration. Thusly, disposed, the joints of each adjoining panel assembly are strengthened, relative to an isolated structural channel.

Another operative feature of the present male and female connector structure is that the male connector may be cooperatively dimensioned with the recess created by the female connector to form a substantially snug fit of the male connector therein, thereby creating a substantially fluid resistant seal between panel assemblies. Thusly disposed, leaks due to a flow of fluid between the panel assemblies are avoided. Similarly, in a health care setting, for example, where cross contamination is desired to be minimized by reduction of air flow between rooms, a fluid resistant seal provides such resistance, especially if adjoining panel assemblies are further treated with a tape and/or compound finish procedure along the joints therebetween. Such tape and/or compound finish may also be applied for aesthetic purposes in order to disguise the seam created by the joint of adjoining panel members.

The connecting members may be interconnected via one or more support members disposed substantially perpendicularly to the connecting members. A support member of the present invention may be an elongate and rigid member of similar, but not necessarily identical, construction to the connecting members. One embodiment of a support member may comprise a structural channel composed of steel or aluminum. A support member may be disposed along the lowermost, or base portion of the panel assembly. Likewise a support member may be disposed along the upper-most, or cap portion of the panel assembly. In embodiments where the support member comprises a structural channel, it may be correspondingly dimensioned with the connecting members such that the connecting members may be inserted into the channel of the support member.

In some embodiments, the invention comprises at least two connector members disposed on opposite ends of at least one, but preferably two support members, thereby creating a rectangular and rigid interior frame upon which panel members may be mounted to form a panel assembly. The structural strength of the panel assembly may be increased by including one or more additional connecting members between the connecting members disposed on opposite ends of the support members.

Yet another operative feature of the present invention is a base member. In at least one embodiment, the base member comprises a channel which may be disposed along a floor of an environment in which the present invention is to be erected; the base portion of the panel assembly may then be inserted in the channel of the base member. The base member provides a variety of functions relative to the present invention. First it can facilitate erection of a plurality of panel assemblies into a wall or partition. Second, it may be configured and arranged to aesthetically simulate a base board, skirt, or base molding. Third, it can provide a seal resistant to the flow of fluid underneath the panel assembly, such as, for example, a flow of air. By way of another example, in embodiments wherein the panel members are comprised of drywall and the base member is comprised of rubber or plastic, the base member can serve to shield the dry wall from wetness and moisture due to spills or mopping in the region of the base member. Lastly, the base member acts to support the panel assemblies, preventing them from rotating.

In at least one embodiment, the base member is an elongate and channel shaped member composed of rubber or plastic. The base member may include one or more operative features to facilitate a secure retention on a floor. For example, the base member may include a plurality of adhesive channels running longitudinally on the surface which abuts the floor. Thus, an adhesive, such as heavy duty construction adhesive, may be effectively utilized to secure the base member to the floor. Alternatively, the base member may be formed of materials that are compliant to standard fasteners, such as nails, screws, or staples, which may be driven through the base member and into the floor. In some embodiments of the present invention, the panel assemblies provided may encompass a substantial portion of the length between the floor and the ceiling of the room in which the panel assemblies are to be disposed. In these embodiments, it will be desirable to provide a base member that exhibits such flexibility as to deform in order to allow the panel assembly to be inserted into the base member, even though the clearance between the panel assembly and the ceiling would not otherwise allow. By way of example, such a base member could be formed of a suitable plastic, such as ABS, PVC, or Vinyl, dimensioned on the order of 1/16" in thickness. If increased rigidity of the base member is instead desired, then it could be formed of a thicker plastic, such as on the order of 1/8", or further still, could be formed of metal.

Yet another operative feature of the present invention is a cap member which may be disposed along a cap portion of the panel assembly. In one embodiment, the cap member may be of roughly similar construction as the base member, being an elongate and channel shaped member composed of rubber or plastic. The cap member can provide a variety of functions relative to the present invention. First, the cap member may include a decorative element disposed on an exterior surface thereof. This decorative element may be aesthetically similar to crown molding, for example, thus adding to the overall aesthetic condition of the panel assembly. Secondly, the cap member may provide a secure cover under which to run electrical or plumbing conduits. Third, the cap member may be disposed between the cap portion of the panel assembly and a ceiling of the room in which the present invention is erected, thus at least partially restricting the passage of fluid between the panel assembly and the ceiling. Lastly, the cap member may be rigidly affixed to the ceiling in a similar fashion as the base member is affixed to the floor, via adhesive or standard fasteners. Thus, the cap member contributes to the stability of the panel assemblies by preventing rotation.

In at least one envisioned use of the present invention, the panel assembly extends to within a few inches of a ceiling, and a cap member must be installed after the panel assembly is erected. Thus in at least one embodiment, the cap member may be comprised of a substantially flexible material such that the cap member may be deformable in order to fit through the ceiling-panel member gap, but also retain such elasticity that the cap member returns to its original form once installed. Alternatively, the cap member may be substantially bisected into two cap segments, each cap segment installed from its respective side of the panel assembly, as necessary.

It will be appreciated that in use of the present invention a plurality of panel assemblies will generally be required in order to construct a partition of a desired length. As desired, each panel assembly may be the same or of differing sizes, but generally each panel assembly will include both a male connector and a female connector.

It will be appreciated by those skilled in the art that the specific structural components of the present invention may also be utilized to construct exterior partitions as well, with only minor modification to the materials utilized. For example, the panel members may be comprised of structural insulated panels, or "SIP" in industry terminology. Furthermore, in such exterior embodiments, the base member may be fabricated from aluminum or steel.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
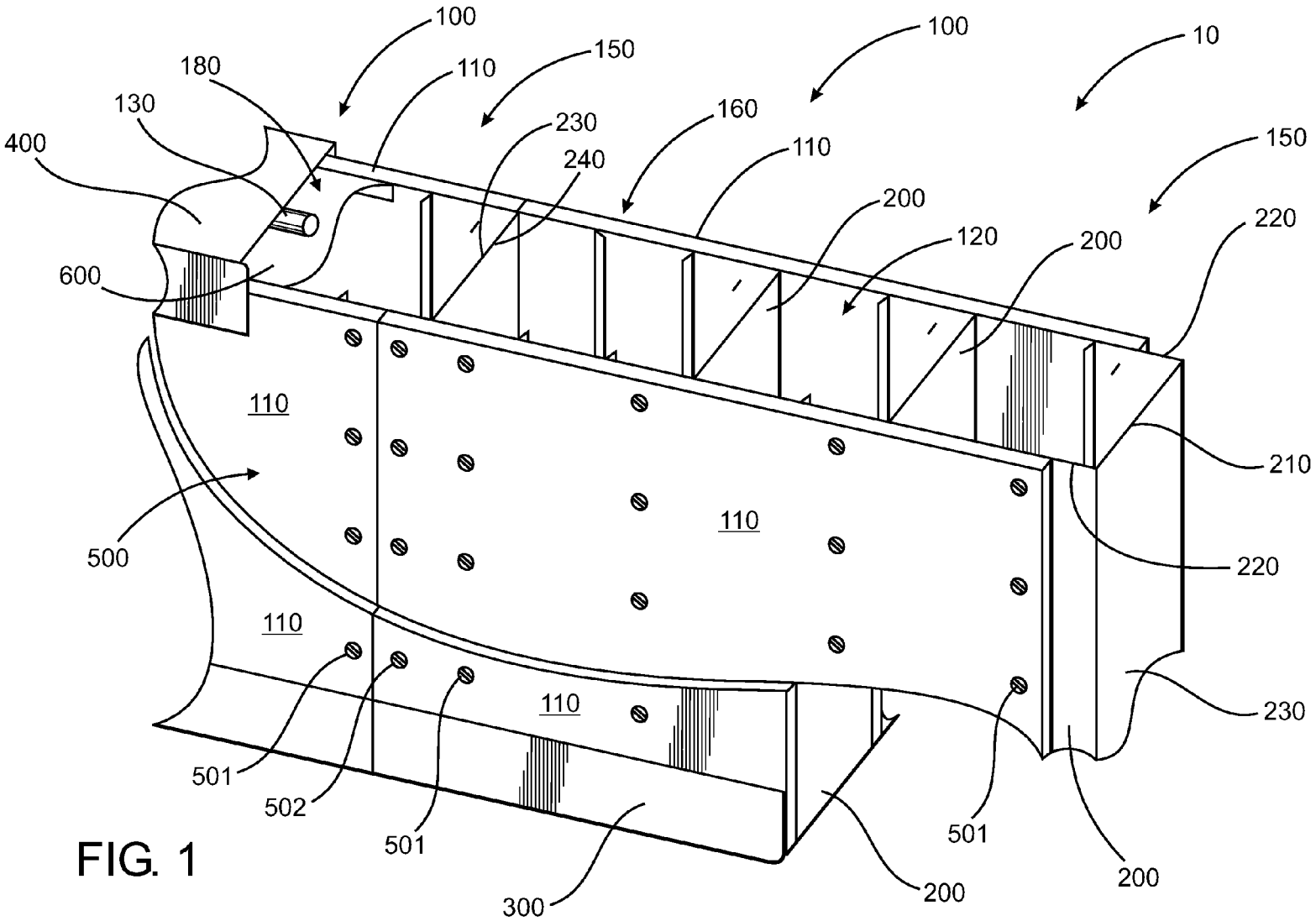
FIG. 1 is a perspective view of a prefabricated panel system in accordance with one embodiment of the present invention.

With reference to FIG. 1, depicted is a portion of one embodiment of a prefabricated panel system 10 in partial cutaway thereof. Two panel assemblies 100 are adjoined together via connectors 200, which may include a male connector 230 disposed in abutting relation to a female connector 240 and securely retained thereto with a plurality of fasteners 500. A support member 600 (depicted in partial cutaway) is disposed along a cap portion 180 of the panel assembly 100 and intermediate the panel members 110. A conduit 130 (depicted in partial cutaway) is disposed in supported relation to the support member 600. A cap member 400 (depicted in partial cutaway) is disposed in overlying relation to the conduit 130 and support member 600 along a cap portion 180 of the panel assembly 100.

As depicted, the connecting members 200 comprise structural channels including a web 210 and two flanges 220 oppositely disposed on each end of the web 210. A connecting member 200 may be disposed on a male connecting end 150 of a panel assembly 100 with the web 210 projecting a predetermined distance therefrom in order to form a male connector 230. Accordingly, another connecting member 200 may be disposed on a female connecting end 160 of a panel assembly 100 with the web 210 recessed inwardly therefrom a predetermined distance in order to form a female connector 240. The connecting members 200 may be securely attached to the panel members 110 via fasteners 500, and specifically connecting member fasteners 501 which are disposed to primarily retain the connecting member 200 in attached relation to the panel member 110. When two panel assemblies 100 are to securely joined, panel assembly adjoining fasteners 502 may be disposed accordingly to primarily retain adjoining panel assemblies 100 in attached relation to each other.

It will be understood that a connecting member fastener 501 and a panel assembly adjoining fastener 502 of the present invention may comprise identical or different fasteners depending upon the desired use and conditions of operation. For example, it may be desirable to provide connecting member fasteners 501 which are configured for rapid and/or automated installation such that mass production of panel assemblies 100 is facilitated. Conversely, it may be desirable to provide a panel assembly adjoining fasteners 502 which are configured for hand installation, to facilitate erection by the end user. By way of another example, it is not strictly necessary to the successful operation of the present invention that the connecting member fasteners 501 be removable, thus they can be configured to be permanently installed, to enhance the strength of the panel assembly 100. However, it may be desirable to provide removable panel assembly adjoining fasteners 502 such that the present invention may be erected temporarily, disassembled, re-erected, and so forth.

Figure 2:
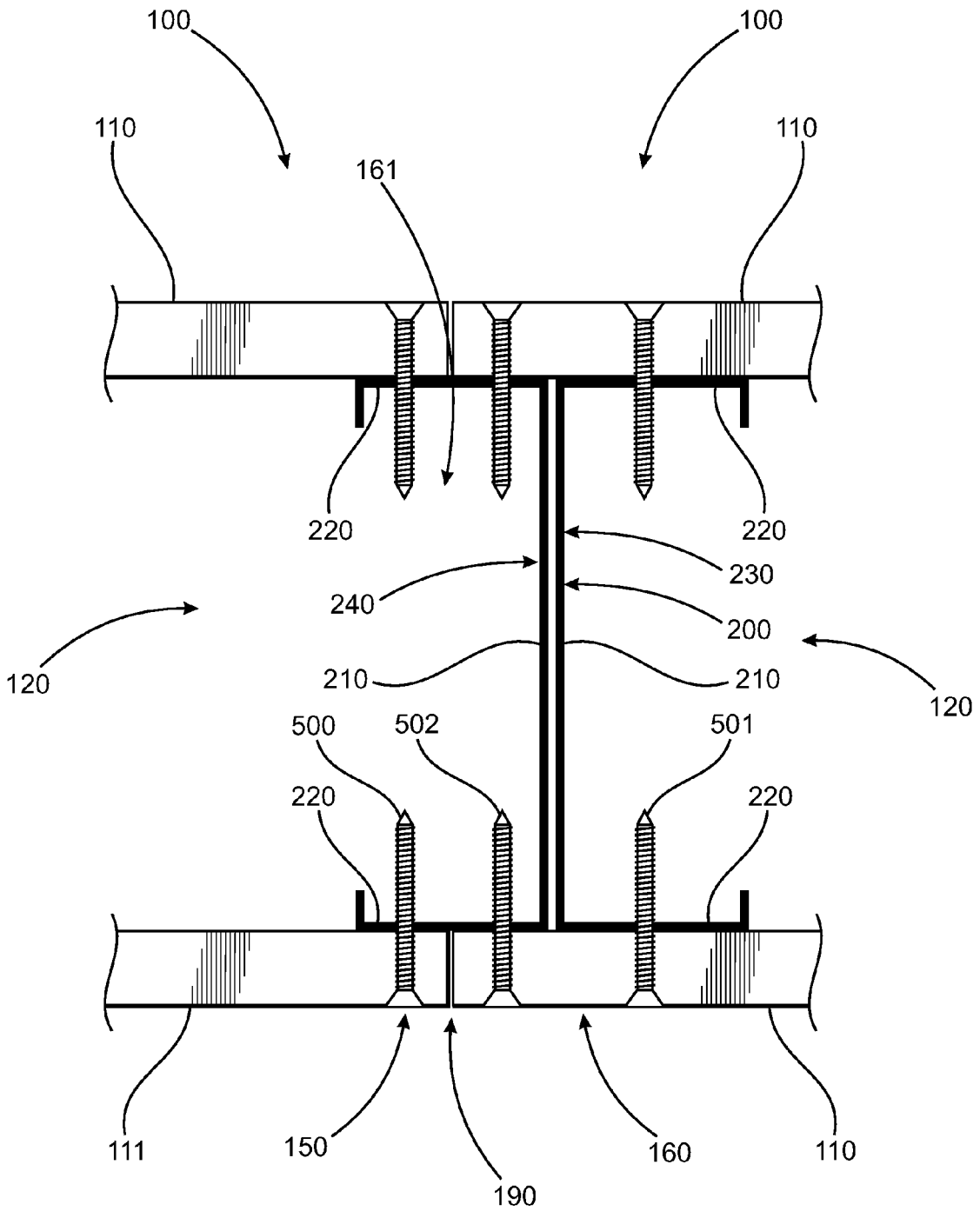
FIG. 2 is a top plan section view of a prefabricated panel system in accordance with one embodiment of the present invention.

With reference to FIG. 2, depicted is a top plan partial cutaway view of a prefabricated panel system 10 in accordance with one embodiment of the present invention. Relative to the depiction in FIG. 1, FIG. 2 presents a more focused view of the interconnection between the male connecting end 150 of one panel assembly 100 and the female connecting end of another connecting assembly 160. Here, the recess 161 of the female connecting end 160 into which the male connector 230 mates is more clearly depicted. The recess 161 is formed by recessing a female connector a predetermined distance inwardly from the female connecting end 160 of a panel assembly.

Also of note in the embodiment FIG. 2 is the abutting relation between the corresponding webs 210 of the male connector 230 and female connector 240. In certain embodiments, it may be desirable to cooperatively dimension the depth of the recess 161 with the length of projection of the male connector 230 such that the male connector 230 and female connector 240 abut when corresponding panel assemblies 100 are adjoined. Thusly disposed, the male connector 230 and female connector 240 form a substantially I-beam configuration, which serves to increase the overall strength of the present invention, and specifically increases the bending stiffness at the adjoining portions of panel assemblies 100.

Further of note in the embodiment of FIG. 2 is the joint 190 formed by corresponding panel members 110 of adjoining panel assemblies 100. Here, the flange 220 of the male connector 230, being disposed substantially across the joint 190, provides a measure of resistance to fluid flow therethrough. As such, the present invention may also be deployed in, for example, healthcare settings, where cross-contamination between partitions of airborne particles is not desirable.

Figure 3:
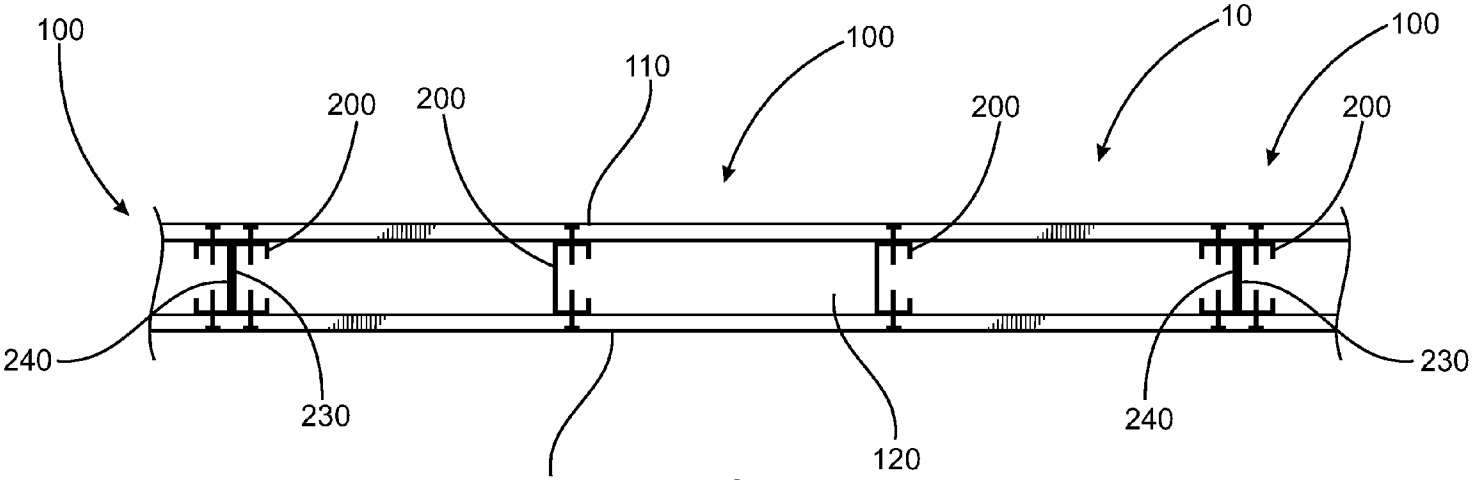
FIG. 3 is a top plan section view of a prefabricated panel system in accordance with one embodiment of the present invention.

With reference to FIG. 3, a top section view of one embodiment of a plurality of panel assemblies adjoined in interconnecting relation to form a partition as provided by the present invention is depicted. Therein, a plurality of connecting members 200 are disposed along the panel assembly 100. One object of the present embodiment is that a plurality of connecting members 200 can increase the structural strength of the panel assembly 100, and particularly can increase the bending stiffness. The connecting members 200 may also be used as mounting structure for a variety of desired objects and/or items such as load bearing shelving, plumbing conduits, window frames, electrical junction boxes, light fixtures, and the like.

Figure 4:
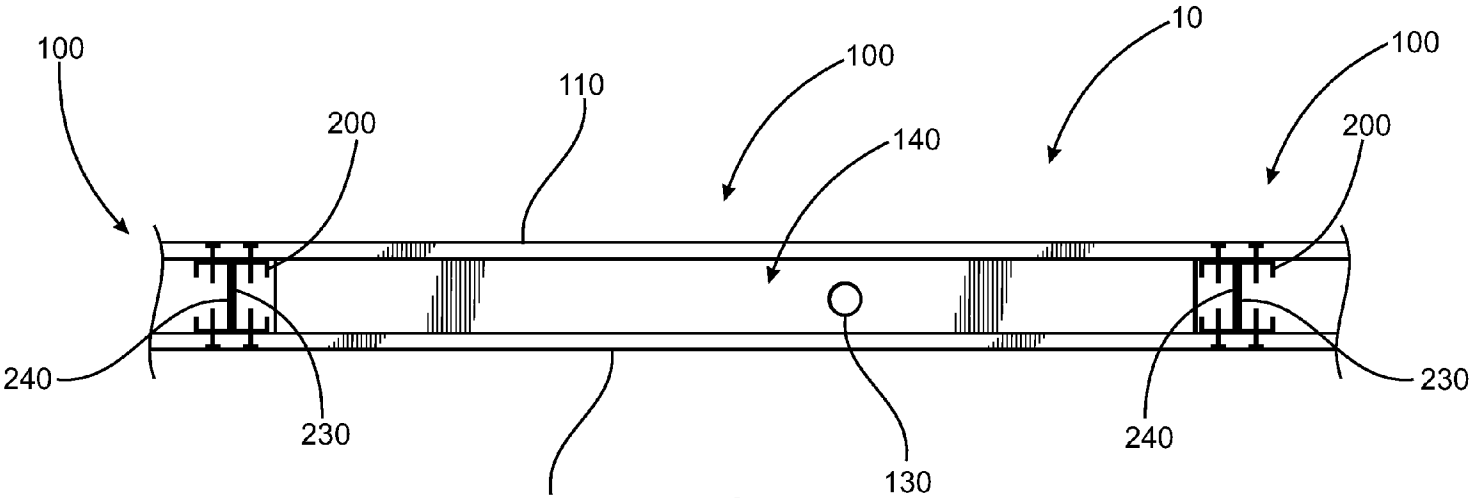
FIG. 4 is a top plan section view of a prefabricated panel system in accordance with one embodiment of the present invention.

Comparing FIGS. 4 and 3, the panel assembly as depicted in FIG. 4 includes a filler material 140 disposed between the panel members 110 of the panel assembly 100. Filler material 140 may be deployed when one or more characteristics of the present invention are desired to be enhanced, such as, for example, thermal insulation, acoustical insulation, fire retardation, and the like. Thus, the filler material 140 provided can comprise a wide variety of application specific material such as fiberglass insulation, expanded polystyrene pellets, and the like. As also depicted in FIG. 4, a conduit 130 is disposed within the filler material 140 by way of illustration only. It will be understood that a conduit 130 is not required, nor is it only available, in any single embodiment of the invention.

Figure 5:
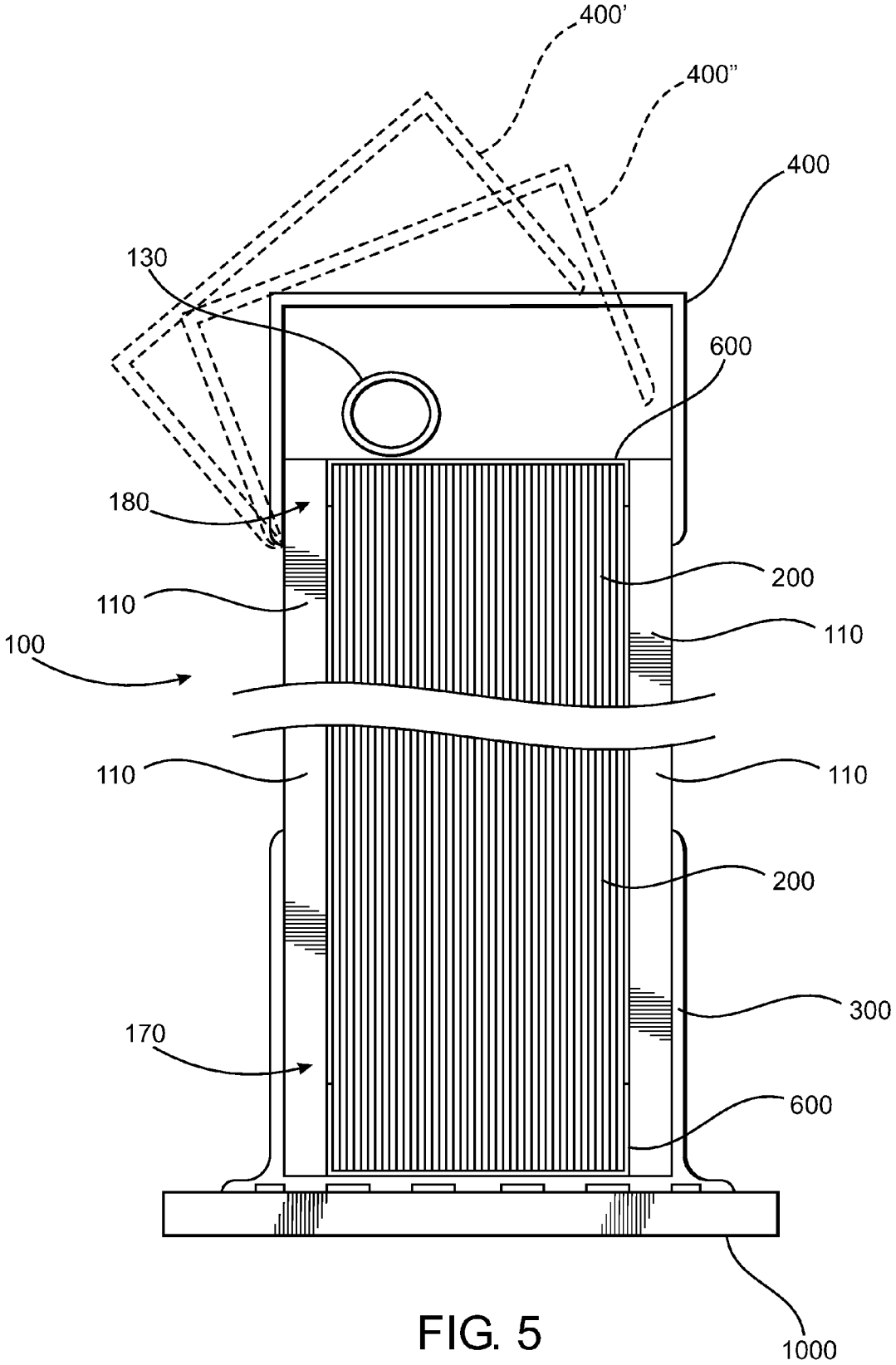
FIG. 5 is a front plan section view of a prefabricated panel system in accordance with one embodiment of the present invention.

With reference to FIG. 5, depicted is a partial cutaway of a panel assembly 100 in accordance with one embodiment of the present invention. The cutaway view is sectioned along a plane passing through a connecting member 200 of the present invention. Support members 600 are disposed along opposing ends of the connecting member 200. Also depicted is the base member 300 disposed on a floor 1000 and a cap member 400 disposed oppositely thereto along the cap portion 180 of the panel assembly 100.

Also depicted in FIG. 5, by way of illustration in broken lines, is a method of installing or disposing the cap member 400 along the cap portion 180. As such, the cap member 400 may be initially oriented approximately as depicted by 400' and then rotated, passing through an orientation approximately depicted as 400", until ultimately the cap member 400 rests in an orientation as substantially depicted by 400.

Figure 6:
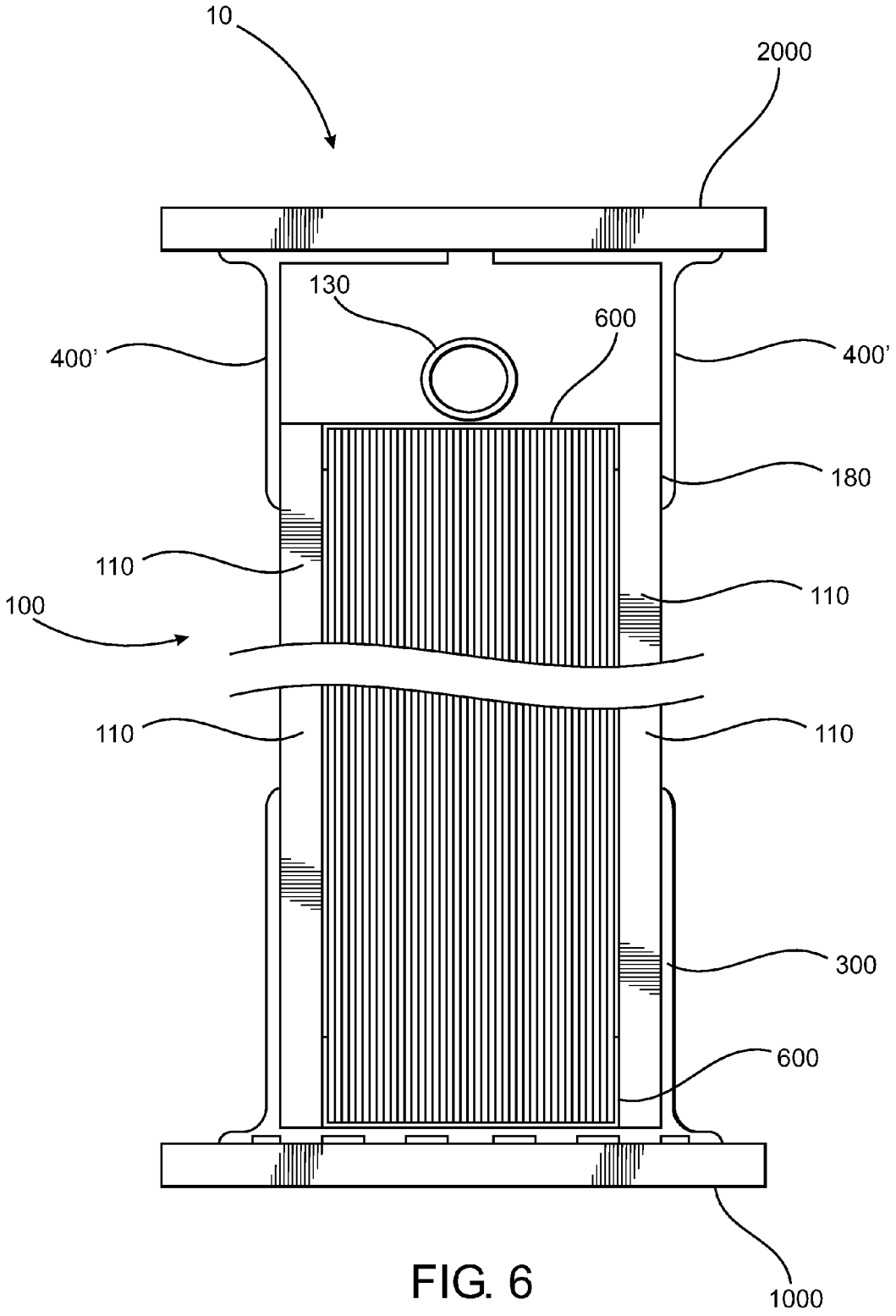
FIG. 6 is a front plan section view of a prefabricated panel system in accordance with one embodiment of the present invention.

With reference to FIG. 6, depicted is a partial cutaway of a panel assembly 100 similar to that depicted in FIG. 5. However, two cap segments 400' are disposed between the ceiling 2000 and the panel assembly. Such a configuration may be desired where, as depicted, the space between the panel assembly 100 and the ceiling 2000 cannot accommodate the placement of a single cap member 400 in overlying relation to the panel assembly 100. Any appropriate method of securely attaching the cap segments 400' to either the panel assembly 100 or the ceiling 2000, or both, such as, for example, fasteners or adhesives, may be utilized. Structurally, the cap segments 400' can comprise an elongate member that is substantially "L" shaped in cross-section. One portion of the cap segment 400' extends along and in abutting relation with the cap segment 180 of the panel assembly 100 and another portion of the cap segment 400' extends along and in abutting relation to the ceiling of the area in which the present invention is deployed. As such, adhesives of fasteners may be used on any portion of the cap segment 400' in order to secure the cap segment 400' to either the panel assembly 100, the ceiling 2000, or both, as desired.

Figure 7:
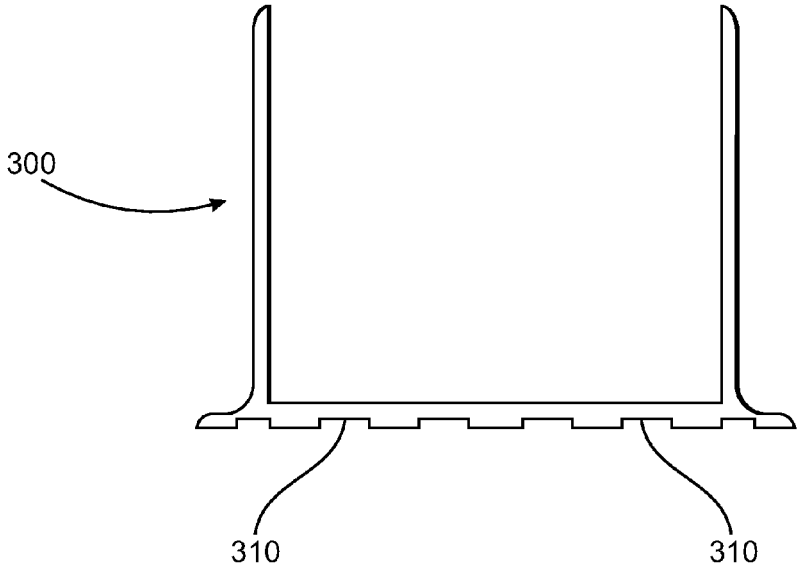
FIG. 7 is a profile view of a base member in accordance with one embodiment of the present invention.

With reference to FIG. 7, a profile view of a base member 300 is depicted. A plurality of adhesive channels 310 are depicted along an exterior surface of the base member 300 and particularly along an exterior surface to be disposed adjoining a floor or other surface upon which the present invention is to be deployed. Such adhesive channels 310 can provide a recess into which an amount of adhesive compound can be disposed thus allowing the base member 300 to be disposed flush against a surface. Thusly disposed, fluid is resisted from flowing between the base member 300 and, for example, a floor.

Figure 8:
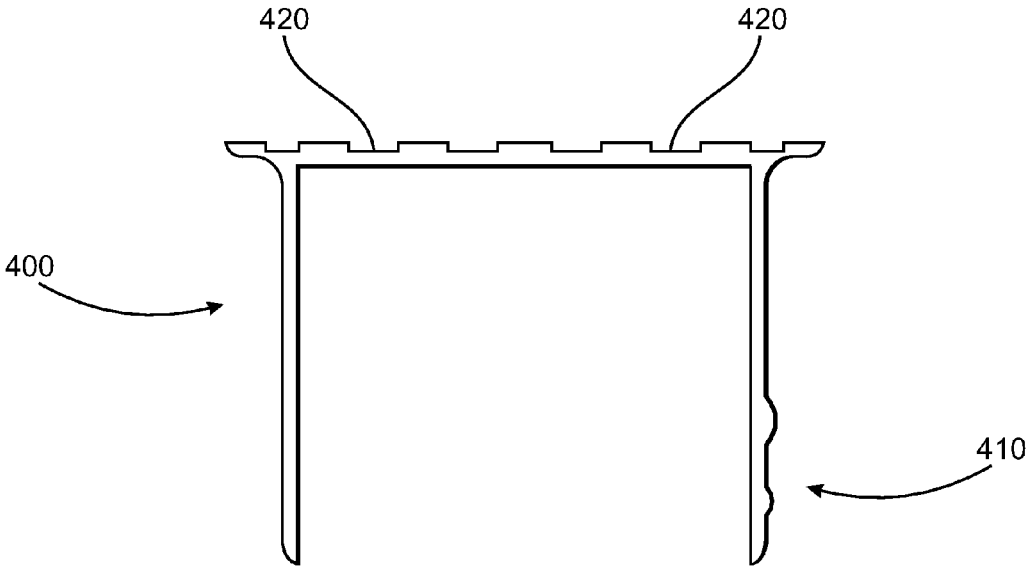
FIG. 8 is a profile view of a cap member in accordance with one embodiment of the present invention.

With reference to FIG. 8, a profile view of a cap member 400 is depicted. A decorative element 410 is disposed on an exterior surface of the cap member 400. Such a decorative element 410 may aesthetically resemble, for example, crown molding. Such a decorative element 410 can contribute to the appearance of the present invention as a permanent wall even where it has been erected as only a temporary partition. Also as depicted, the cap member 400 may include a plurality of adhesive channels 420 similar in structure and orientation as the adhesive channels 310 of the base member 300.

Figure 9:
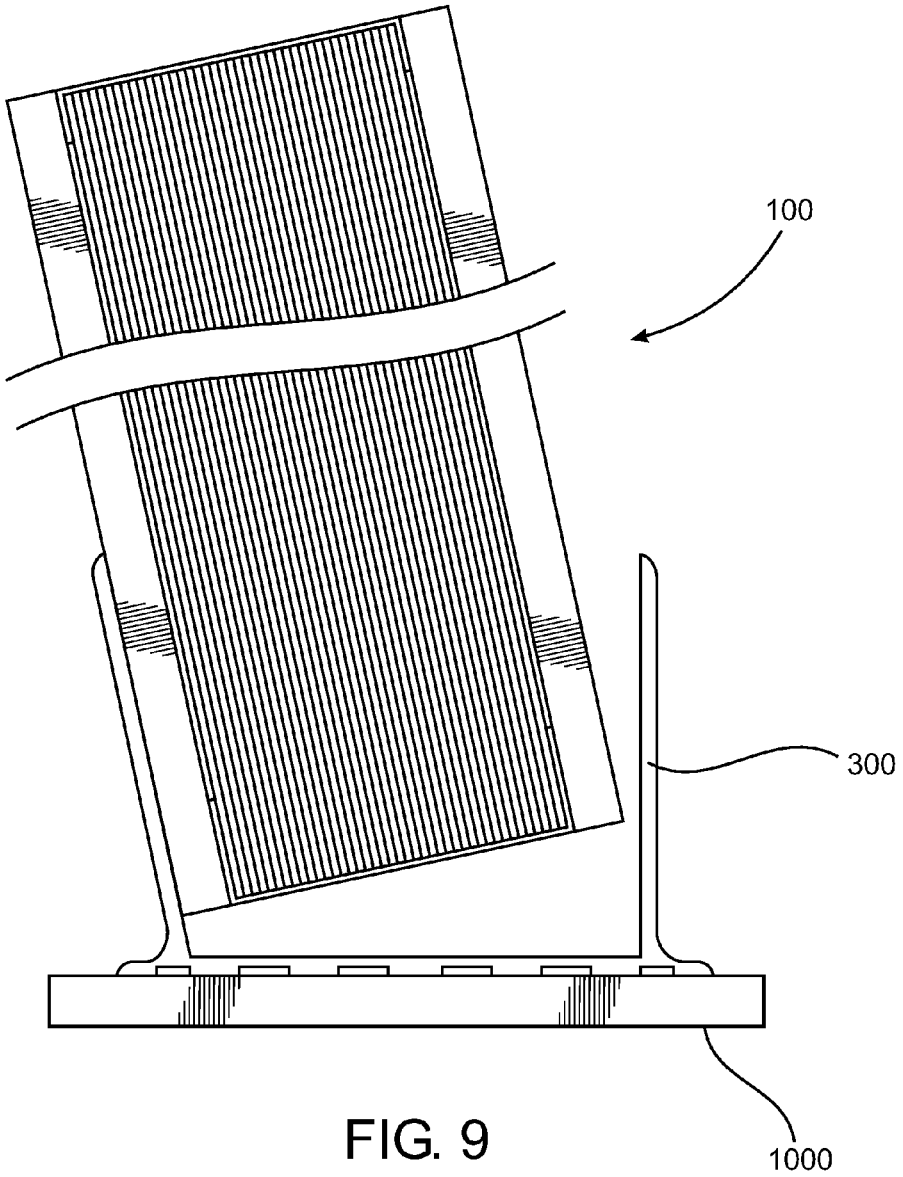
FIG. 9 is a front plan section view of a prefabricated panel system in accordance with one embodiment of the present invention.

With reference to FIG. 9, a panel assembly 100 of the present invention is depicted in an orientation as would be found in one method of installing a panel assembly 100 in a base member 300. As depicted, the base member 300 is at least partially deformed as a panel assembly 100 is inserted therein in an angled orientation. Such method of installation is particularly suitable in situations where, for example, the panel assembly 100 may not be inserted and slid along the path of the base member 300, but instead must be "wedged" or "rotated" therein. It will be appreciated by those skilled in the art that in embodiments where such method of installation is desirable, the base member 300 should be constructed of such material as to exhibit substantially flexible qualities. To wit, it will be desirable that the base member 300 be capable of substantial elastic deformation to allow the panel assembly to be rotated into place, as depicted in FIG. 9. Furthermore, it would not be desirable for the base member 300 to exhibit plastic deformation during this process such that the base member 300 would not be capable of returning substantially to its original form once the panel assembly 100 is fully inserted.

Figure 10:
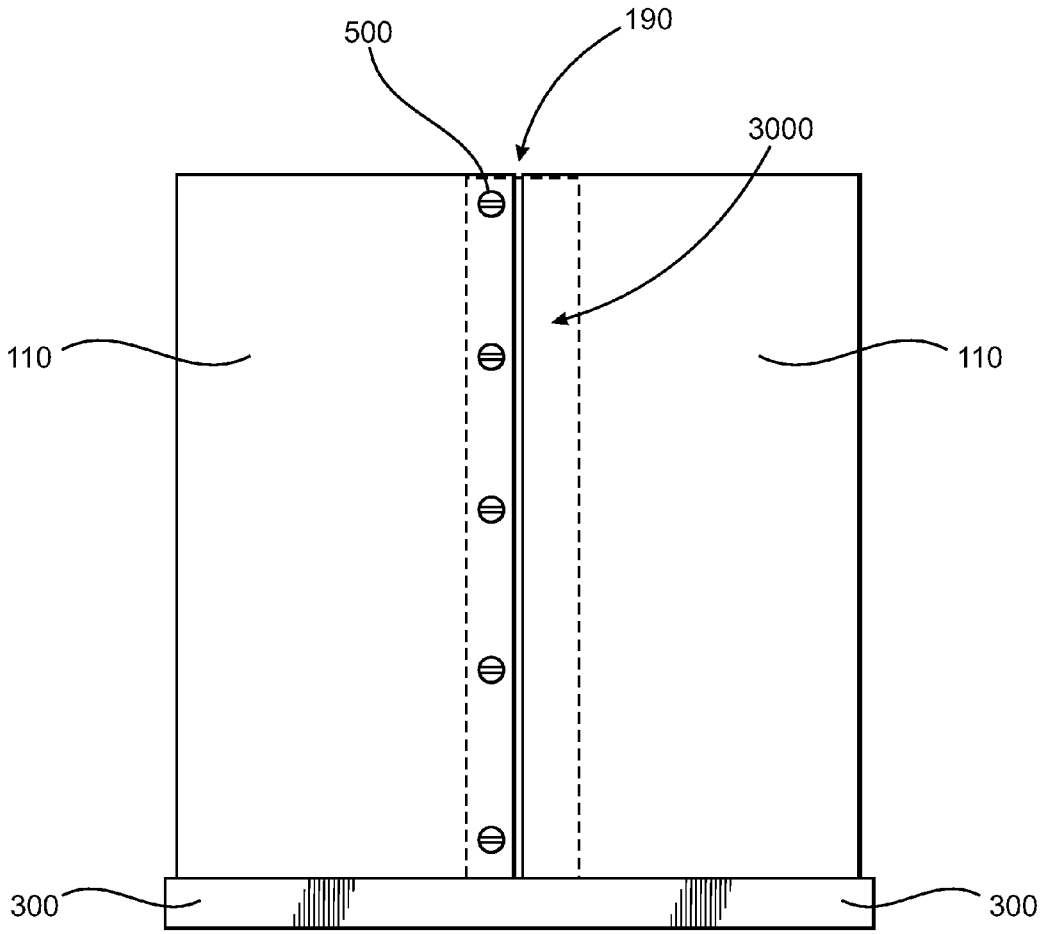
FIG. 10 is a side plan section view of a prefabricated panel system in accordance with one embodiment of the present invention.

With reference to FIG. 10, depicted is an adjoining region 3000 spanning across the joint 190 of two correspondingly disposed panel members 110. In certain deployments of the present invention it will be desirable to perform any of a variety of finishing operations on or to the adjoining region 3000. By way of example, joint tape and drywall compound may be applied to the adjoining region 3000 to give the appearance of a seamless transition between correspondingly disposed panel members 110. Furthermore, it may be desirable to sand and paint the adjoining region 3000 to enhance the effect.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A prefabricated panel system comprising:

at least one panel assembly comprising two panel members disposed in spaced relation via a plurality of connecting members disposed therebetween;

said panel assembly comprising a male connecting end and a female connecting end;

said panel assembly further comprising a base portion and a cap portion disposed oppositely one another;

at least one of said plurality of connecting members defining a male connector, disposed on said male connecting end, projecting therefrom a predetermined distance;

at least one of said plurality of connecting members defining a female connector disposed on said female connecting end and recessed therefrom a corresponding predetermined distance;

said female connector at least partially defining a recess in said female connecting end; and, a base member comprising an open-ended channel into which said base portion of said panel assembly is disposable;

wherein said base member is capable of elastic deformation to rotatably receive at least said base portion therein.

2. A prefabricated panel system as recited in claim 1 further including at least one other panel assembly, said one other panel assembly including at least a male connector disposable within said recess of said female connecting end of said at least one panel assembly.

3. A prefabricated panel system as recited in claim 2 further including a plurality of fasteners disposed into said female connecting end of said one panel assembly and through said male connector of said one other panel assembly.

4. A prefabricated panel system as recited in claim further including at least one support member interconnecting said male connector and said female connector.

5. A prefabricated panel system as recited in claim 1 wherein said base member further comprises a plurality of adhesive channels disposed on an exterior surface thereof structured to receive an adhesive therein.

6. A prefabricated panel system as recited in claim 1 further including a cap member comprising an open ended channel disposable over said cap portion of said panel assembly.

7. A prefabricated panel system as recited in claim 6 further including a plurality of support members each disposed in interconnecting relation between said male connector and said female connector; at least one of said plurality of support members disposed along said cap portion of said panel assembly and at least one of said plurality of support members disposed along said base portion of said panel assembly.

8. A prefabricated panel system as recited in claim 6 wherein said cap member comprises a plurality of cap segments, each separately disposable over said cap portion of said panel assembly.

9. A prefabricated panel system as recited in claim 6 wherein said cap member is further disposable in adjoining relation between said cap portion of said panel assembly and a ceiling of an area in which said panel assembly is disposed.

10. A prefabricated panel system as recited in claim 6 wherein said cap member is cooperatively dimensioned with said cap portion to provide clearance for a conduit to be disposed between said cap portion and said cap member.

11. A prefabricated panel system as recited in claim 9 wherein said cap member includes a decorative element disposed on an exterior surface thereof.

12. A prefabricated panel system as recited in claim 1 wherein an air gap is disposed between said two panel members.

13. A prefabricated panel system as recited in claim 12 further comprising at least one conduit disposed within said air gap.

14. A prefabricated panel system as recited in claim 1 wherein at least one of said two panel members comprises a substantially weather resistant material.

15. A prefabricated panel system as recited in claim 1 wherein at least one of said two panel members comprises drywall.

16. A prefabricated panel system as recited in claim 1 wherein said plurality of connecting members comprise structural channels.

17. A prefabricated panel system comprising:

a plurality of panel assemblies, each comprising two panel members disposed in spaced relation via a plurality of connecting members disposed therebetween;

each of said panel assemblies comprising a male connecting end and a female connecting end;

each of said panel assemblies further comprising a base portion and a cap portion disposed oppositely one another;

at least one of said plurality of connecting members of each of said panel assemblies defining a male connector disposed on each of said male connecting ends, projecting therefrom a predetermined distance;

at least one of said plurality of connecting members of each of said plurality of panel assemblies defining a female connector disposed on each of said female connecting ends and recessed therefrom a corresponding predetermined distance;

each of said female connectors at least partially defining a recess in each of said female connecting ends;

at least some of said male connectors disposed within said recess of a correspondingly disposed female connecting end;

a plurality of fasteners disposed into said correspondingly disposed female connecting ends and through said male connectors of said plurality of panel assemblies;

wherein each of said plurality of connecting members comprise identically formed structural channels; and, a base member comprising an open-ended channel into which said base portion of said panel assembly is disposable; wherein said base member is capable of elastic deformation to rotatably receive at least said base portion therein.

* * * * *